US006048050A

United States Patent [19]

Gundlach et al.

[11] Patent Number: 6,048,050

[45] Date of Patent: Apr. 11, 2000

[54] ELECTRORHEOLOGICAL BASED DROPLET EJECTING PRINTER

[75] Inventors: Robert W. Gundlach, Victor, N.Y.; Eric G. Rawson, Saratoga, Calif.

[73] Assignee: Xerox Corporation, Stamford, Conn.

[21] Appl. No.: 08/140,658

[22] Filed: Oct. 21, 1993

[51] Int. Cl.[7] ..... B41J 2/135

[52] U.S. Cl. ..... 347/46; 347/55

[58] Field of Search ..... 347/46, 6, 55

[56] References Cited

U.S. PATENT DOCUMENTS

| | | | |
|---|---|---|---|
| 4,014,693 | 3/1977 | Clark | 430/117 |
| 4,687,589 | 8/1987 | Block et al. | 252/73 |
| 4,744,914 | 5/1988 | Filisko et al. | 252/74 |
| 4,751,530 | 6/1988 | Elrod et al. | 347/46 |

OTHER PUBLICATIONS

Halsey, T. C.; and Martin, J. E., "Electrorheological Fluids," Scientific American, Oct. 1993, pp. 58–64.

*Primary Examiner*—John Barlow
*Assistant Examiner*—Craig A. Hallacher

[57] ABSTRACT

Electrorheological based acoustic droplet ejectors and their applications in acoustic print heads are described. The droplet ejectors include an acoustic transducer which generates acoustic energy into a fluid well holding an electrorheological fluid such that the fluid's free surface is adjacent electric field electrodes. The acoustic energy is such that droplets are ejected from the fluid as long as a lower voltage is applied to the electrodes. However, when a higher voltage is applied to the field electrodes, the electrodes produce an electric field through the fluid which causes the viscosity of the fluid to increase sufficiently that droplet ejection is prevented. When used in a print head, the electrorheological fluid is an ink. Further, many (perhaps thousands) of individual droplet ejectors are formed in the print head. By controlling droplet ejection from the individual print heads, an image can be produced on a recording medium.

19 Claims, 3 Drawing Sheets

ELECTRORHEOLOGICAL BASED DROPLET EJECTING PRINTER

This invention relates to acoustic ink printing.

BACKGROUND OF THE INVENTION

Various types of droplet ejecting printer technologies have been or are being developed. One such technology, acoustic ink printing (AIP), uses focused acoustic energy to eject marking material (generically referred to herein as ink) onto a recording medium. More detailed descriptions of AIP can be found in U.S. Pat. Nos. 4,308,547, 4,697,195, and 5,028,937, and the citations therein.

While AIP appears promising, most acoustic ink printers rely on selectively applying RF drive voltages to piezoelectric transducers to control ejection. The switching of RF drive voltages complicates AIP.

Another droplet ejection control technique is described in co-pending U.S. patent application Ser. No. 07/940,596 entitled, "Droplet Ejection by Acoustic and Electrostatic Forces." In that application, droplet ejection is induced by the simultaneous application of RF voltage to a transducer (to generate sufficient acoustic energy to create a "mound" of an ink) and of voltage to an electrode near the mound (to create an electrostatic field). Since the RF voltage by itself is insufficient to eject a droplet, the application of the electrode voltage controls ejection.

While combining RF drive signals with electrostatic fields is promising, since a system as described in Ser. No. 07/940,596 depends on additive forces it may not be optimum. Additive forces are a problem since the size and trajectory of ejected droplets depend upon the interactions of difficult to control variables such as the RF voltage, the resulting acoustic energy, the focus of the acoustic energy, the effect of the electric field on the ink, and the viscosity of the ink. Since uncharged fluids are attracted to electric fields, the use of electric fields to stop ejection, rather than to trigger it, using a system such as that described in Ser. No. 07/940,596 is not simple.

However, in the 1940's Winslow reported that electric fields increase the viscosity of some fluid; this property is called electrorheology. Importantly, an increase in viscosity makes acoustic droplet ejection more difficult. More recently, Professor Frank Filisko of the University of Michigan has reported on electrorheological fluids comprised of aluminosilicate ceramic particles suspended in various oils. Further, various mixtures of mineral oil and corn starch are electrorheological (about 1 to 5 parts by weight of corn starch to mineral oil gives good results). Other electrorheological fluids include corn starch in silicon oil, and a composition made by "belt mixing chlorinated polypropylene or copolymers of ethylene methacrylic acid at 115° C. with carbon black and isopar, a mineral oil, in an attiter containing stainless steel beads." The last two fluids are from a conference on electrorheology held Aug. 7–9, 1989 at the McKimmen Center, Raleigh, N.C. Finally, D. G. Frood of Lakehead University, Canada, has reported electrorheology in "various concentrations of potato starch in 50 centistoke silicone oil" (electroviscous effects are seen for fields of about 400 to 2000V/mm).

Therefore, it would be advantageous to utilize electrorheology in acoustic ink printing, particularly in a manner such that the switching of RF drive voltages is not required.

SUMMARY OF THE INVENTION

The present invention provides for acoustic droplet ejectors which use electrorheological inks.

An acoustic droplet ejector according to one embodiment of the present invention includes an acoustic transducer generating sound waves through a container having an opening. The container holds an electrorheological ink such that the fluid has a free surface near the opening. Adjacent the opening are electrodes for creating electric fields across the opening and into the ink.

In operation, the sound waves eject droplets of the ink from the opening if a low voltage (possibly zero) is applied to the electrodes. However, when a high voltage is applied to the electrodes, the resulting electric field increases the viscosity of the ink sufficiently that the acoustic energy is no longer able to eject droplets. Thus by controlling the voltage across the electrodes, droplet ejection can be controlled.

In practice, it may be beneficial to simultaneously fabricate hundreds or thousands of electrorheological acoustic droplet ejectors in a single print head. In one such print head, the electrorheological acoustic droplet ejectors are formed along a line. A linear acoustic transducer radiates acoustic energy into a cylindrical acoustic lens within an elongated channel. The elongated channel has narrower regions and wider regions in the direction transverse to the axis of the channel. Electrodes are aligned opposite the wider regions of the channel. A burst of sound from the acoustic transducer passes through the acoustic lens and causes ink to rapidly rise along the center of the channel. When the voltage applied to the electrodes is sufficiently low (possibly zero), the viscosity of the ink is sufficiently low that the acoustic radiation pressure ejects droplets. When a sufficiently high voltage is applied to the electrodes, the ink becomes sufficiently viscous that ejection is inhibited. The channel widths and the electrode voltages are such that droplet ejection takes place only from the wider regions of the channel.

BRIEF DESCRIPTION OF THE DRAWINGS

Various aspects of the present invention will become apparent as the following description proceeds and upon reference to the drawings in which.

The following makes reference to various directional signals, such as right, left, up, and down. Those signals, which are taken relative to the drawings, are meant to aid the understanding of the present invention, not to limit it in any way.

DETAILED DESCRIPTION OF THE ILLUSTRATED EMBODIMENT

The present invention provides for electrorheology based acoustic droplet ejectors and printers. To assist in understanding the present invention, a simple electrorheological acoustic droplet ejector and its operation is described. Then, an embodiment of an electrorheological acoustic print head which contains many individual droplet ejectors is described.

AN ELECTRORHEOLOGICAL ACOUSTIC DROPLET EJECTOR

Figure 1:
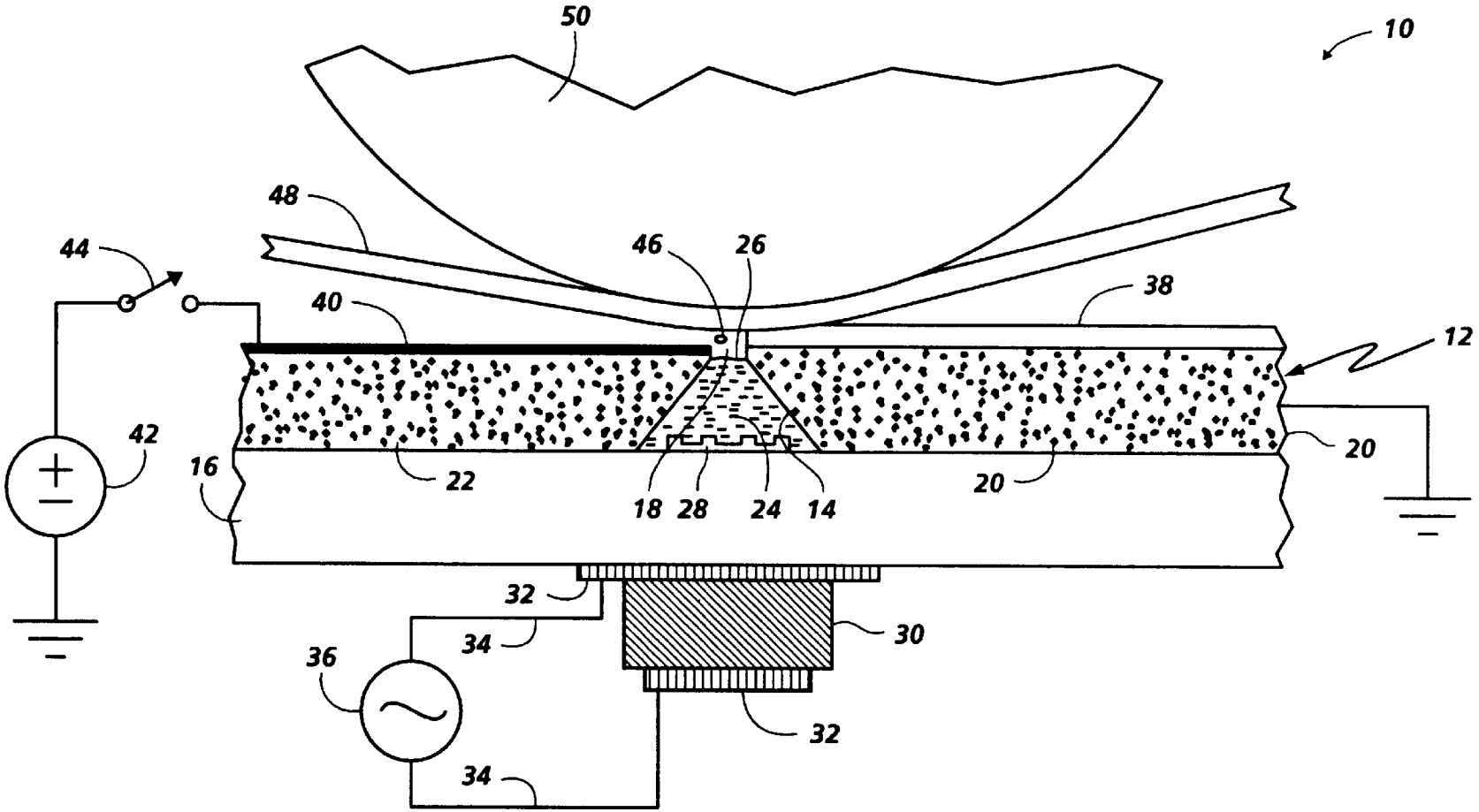
FIG. 1 shows a simplified schematic diagram of an electrorheological acoustic droplet ejector according to the principles of the present invention.

Turn now to FIG. 1 where an illustrative acoustic droplet ejector 10 is depicted. The acoustic droplet ejector 10 includes a plate 12 having a trapezoidal shaped aperture 14. The plate 12 mounts on a 30 mil thick 7740 glass (pyrex) base plate 16 which seals off the bottom of the aperture 14, forming an ink well with an opening 18. The plate 12 has two parts, a first part is comprised of an electrically conductive material 20 (shown on the right in FIG. 1), and the second is comprised of an electrically insulating material 22 (shown on the left in FIG. 1).

Inside the ink well is 1) an electrorheological fluid 24 which fills the ink well so as to create a free surface 26 near the opening 18, and 2) a spherical fresnel acoustic lens 28 (other embodiments may use a cylindrical acoustic lens). Below the base plate 16, and axially aligned with the ink well, is a ZnO acoustic transducer 30 that is sandwiched between electrical terminals 32. Connected to the terminals 32 via wires 34 is an RF source 36 suitable for driving the acoustic transducer 30. It is to be understood that the RF source 36 outputs bursts of RF drive energy to the acoustic transducer 30.

Above the electrically conductive part of the plate 12 (made from the electrically conductive material 20) is an insulating teflon layer 38. Over the remainder of the plate is an electrically conductive layer 40. The electrically conductive part of the plate 12 connects to the negative (or positive) terminal of a voltage source 42 (shown as ground in FIG. 1). The positive (or negative) terminal of the voltage source connects via a switch 44 to the conductive layer 40.

OPERATION

To eject a droplet form the droplet ejector 10, the RF source 36 applies an RF voltage to the acoustic transducer 30. That transducer converts the RF voltage into a burst of acoustic energy which passes through the base plate 16 and into the acoustic lens 28. The acoustic lens focuses the acoustic energy into a focal area at (or very close to) the free surface 26 of the electrorheological fluid 24. In response, droplets 46 of the electrorheological fluid 24 are ejected from the free surface. In practice, the droplets 46 mark a recording medium 48 that is moved past the opening 18 in a controlled fashion (such as by a roller 50).

To inhibit droplet ejection, the switch 44 is closed, thereby applying the DC output of the voltage source 42 across the conductive layer 40 and the conductive part of the plate 12 (the conductive part being the material 20). With the DC voltage applied, the conductive layer and the conductive part of the plate form electric field electrodes which induce an electric field across the opening 18 and through the electrorheological fluid 24. In response to the electric field, the viscosity of the electrorheological fluid 24 increases sufficiently that ejection is inhibited.

Thus by controlling the application of a DC voltage across the conductive layer 40 and the conductive part of the plate 12, droplet ejection can be controlled. As the rate of droplet ejection in most applications will be high, the switch 44 should be a transistor.

AN ELECTRORHEOLOGICAL ACOUSTIC PRINT HEAD

While the construction and operation of the inventive acoustic droplet ejector illustrated in FIG. 1 is described above in relation to a single droplet ejector, in practice hundreds or thousands of droplet ejectors may be formed in a single print head. Then, by controlling ejection from the various droplet ejectors as a recording medium passes by the print head, a desired image can be created.

Figure 2:
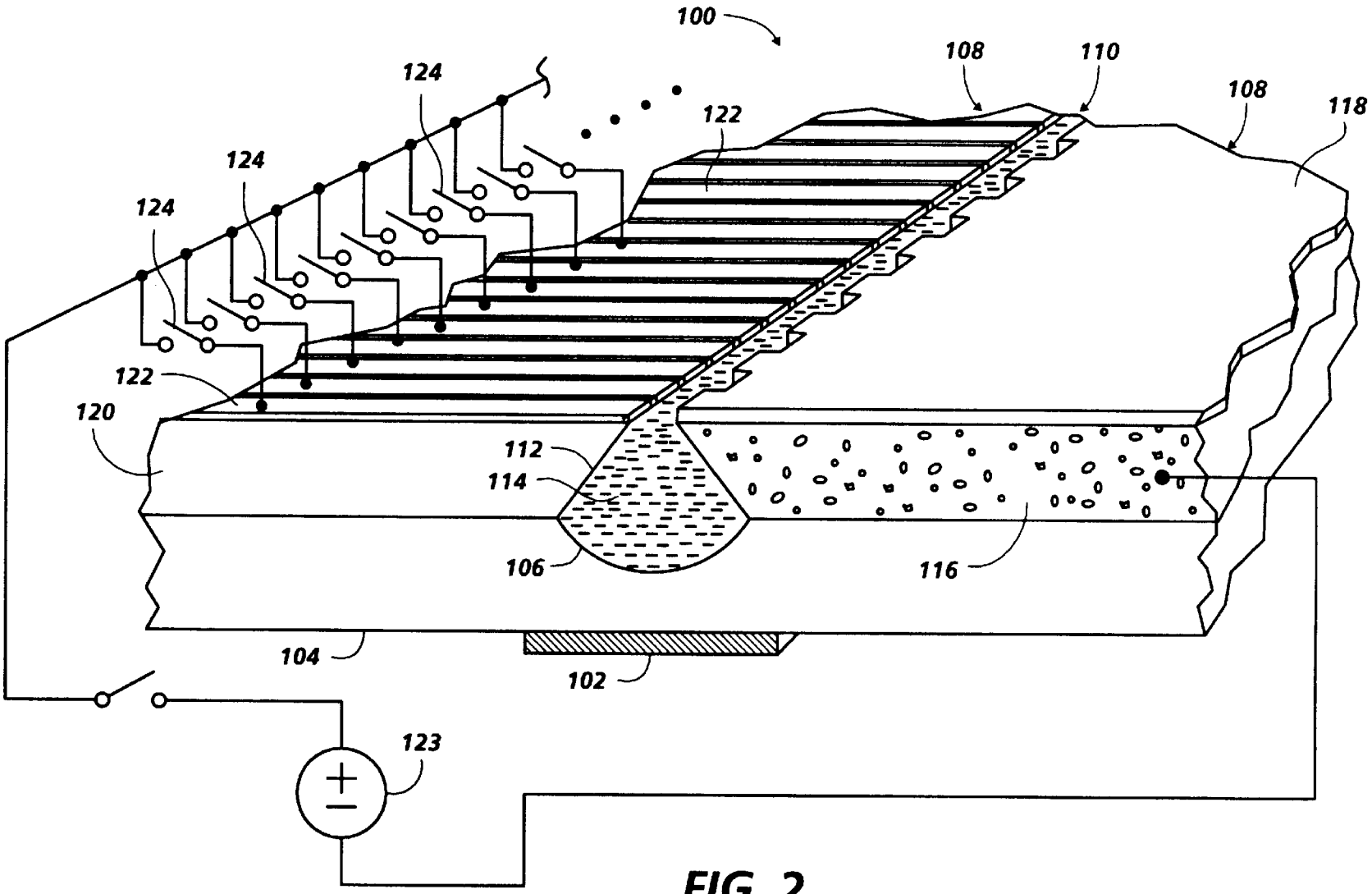
FIG. 2 shows one embodiment of an electrorheological acoustic print head according to the principles of the present invention.

An embodiment of an electrorheological print head 100 containing a plurality of droplet ejectors is shown in FIG. 2. In that embodiment an acoustic transducer 102 generates acoustic energy which passes into a base plate 104. The acoustic transducer 102 may be an individual transducer or a transducer array. It is to be understood that the acoustic transducer is connected via input terminals to a source of bursts of RF drive energy (in a manner similar to the terminals 32, wires 34, and RF source 36 in FIG. 1). Those elements are not shown for clarity.

The acoustic energy passes through the base plate 104 and into a long, cylindrical lens 106 (which could be a fresnel cylindrical lens). The cylindrical lens avoids the problems of forming an individual spherical lens (as shown in FIG. 1) for each droplet ejector.

Over the base plate 104 is a plate 108 having a specially shaped groove 110 that is aligned with the cylindrical lens, thereby forming a channel 112. The channel 112 holds an electrorheological fluid 114 such that the fluid has a free surface near the top of the plate 108. The location near the top of the plate is referred to hereinafter as the channel opening. The channel opening, an important feature of the electrorheological print head 100, is described below. One side (to the right in FIG. 2) of the plate 108 is made from an electrically conductive material 116 that is overlayed by an insulating layer 118, beneficially of teflon. That conductive material acts as an electric field electrode for each of the droplet ejectors. The other side (to the left in FIG. 2 and toward the top in FIG. 3) of the channel 112 is comprised of an insulating body 120 overlayed by a plurality of conductive electrodes 122. The conductive electrodes cover about 80% of the top surface of the insulating body. Each conductive electrode 122 acts as an electric field electrode for one of the droplet ejectors.

A DC voltage source 123 is selectively connected between individual ones of the conductive electrodes 122 and the conductive material 116 by a plurality of switches 124 (beneficially transistors). While not shown, it is assumed that each switch is connected to an electronic assembly which selects the state of each switch. Such electronic assemblies are well known to those skilled in the applicable arts.

Figure 3:
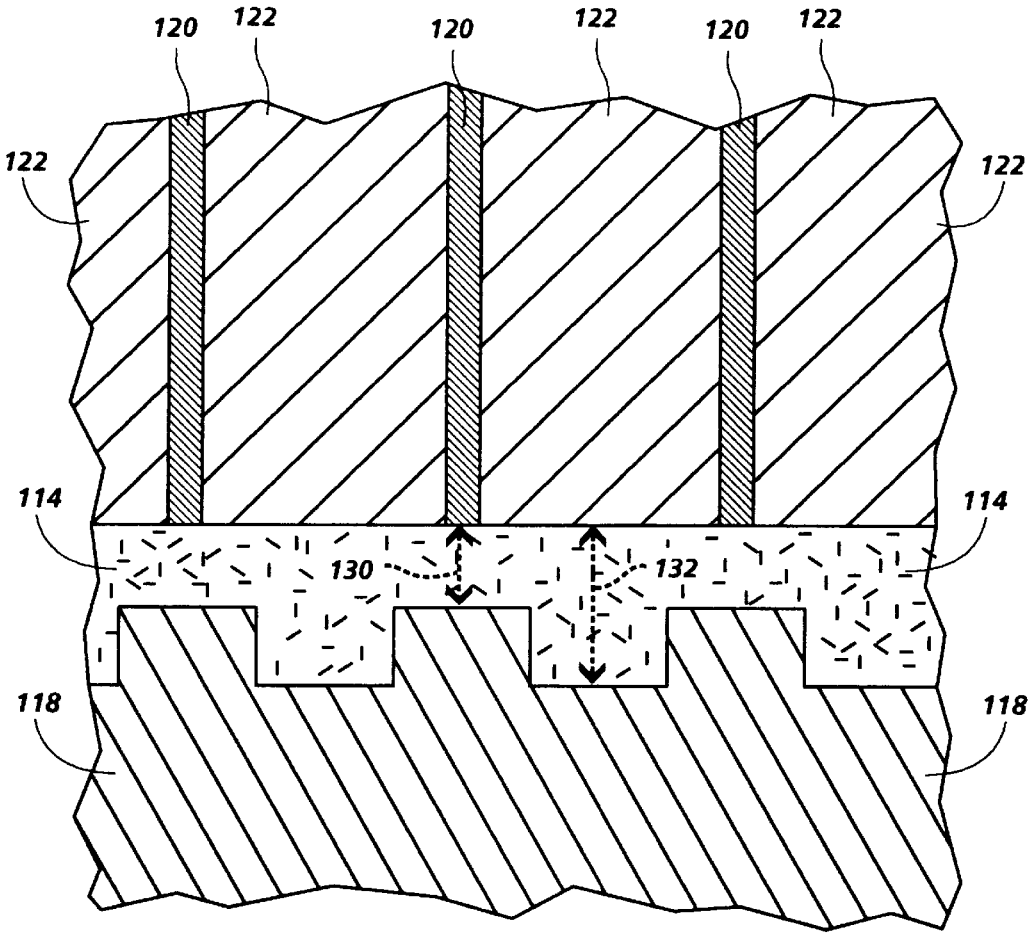
FIG. 3 is a top-down view of a section of the print head shown in FIG. 2.

A top-down view of the channel opening is shown in FIG. 3. As shown, the spacing between the insulating layer 118 and the insulating body 120/conductive electrodes 122 alternate between narrow spacings 130 and wide spacings 132. Aligned with the centers of the narrow spacings 130 are gaps between adjacent conductive electrodes 122. Aligned with the centers of the wide spacings 132 are the centers of the conductive electrodes 122.

OPERATION OF THE PRINT HEAD

Referring now to FIG. 2, in operation, the acoustic transducer 102 generates a burst of acoustic energy along the channel 112 and through the base plate. The cylindrical lens 106 focuses the acoustic energy into an elongated focal area near the free surface of the electrorheological fluid 114. When all switches 124 are open, ink droplets are ejected from all droplet ejectors by the focused burst of acoustic energy. However, when a switch 124 closes, the voltage from the voltage source 123 is applied between the electrode 122 that is associated with the switch 124 and the conductive material 116. The induced electric field passes through the electrorheological fluid 114, increasing its viscosity. In response, droplet ejection from the associated droplet ejector is inhibited.

The purpose of arranging the elements as shown in FIG. 3 is to determine the location at each ejector from which droplets are ejected. This is important since accurate placement of an ejected droplet on a recording medium is usually required. Complicating the problem of obtaining an accurate ejection location are the surface interactions between the electrorheological fluid 114 and the walls of the plate 108. Thus, ejection should take place sufficiently far from the walls that surface interactions are relatively insignificant.

With the arrangement shown in FIG. 3, when the electric field is removed from the electrorheological fluid (a switch 124 opens), viscosity drops faster in the associated wide spacing 132 than in the adjacent narrow spacings 130 (since, for a given applied voltage, the electric field is greater across the narrow spacings). Thus, droplet ejection preferentially takes place from within the wide spacings.

The arrangement shown in FIG. 3 is not unique. For example, both edges (walls adjacent the channel) could be scalloped, or one or both edges take any number of other shapes, such as sinusoidal. It is desirable, however, to spatially vary the electric field so that the location of droplet ejection is determined. In practice, one will find it beneficial to make the arrangement of elements periodic, with the period being equal to the desired droplet ejector separation (which equals the droplet separation).

While ejection has been described above as occurring when the voltage applied to the electric field electrodes are zero (switches open), it may be beneficial to switch the voltages applied to the electric field electrodes from a high level (inhibiting ejection) to a low, but not zero, level (to enable ejection). Switching between high and low voltages, in combination with variations in the widths of the channel, helps in maintaining ejection only from desired locations in the droplet ejectors. For example, if the width of the narrow spacings 130 and low level voltage are properly adjusted relative to each other, droplet ejection from the narrow spacings can be prevented. Further, by properly adjusting the wide spacings, the low voltage level, and the high voltage level, the location of ejection can be electronically influenced. Then, variations in the high and low voltage levels would permit adjustments for manufacturing variations or aging of the droplet ejectors.

From the foregoing, numerous modifications and variations of the principles of the present invention will be obvious to those skilled in its art. Therefore the scope of the present invention is to be defined by the appended claims.

What is claimed:

1. An acoustic droplet ejector, comprising:

a container configured to hold an electrorheological fluid having a viscosity dependent on strength of an induced electric field;

an electrode positioned to alternately induce a low and a high strength electric field in the electrorheological fluid, with viscosity of the electrorheological fluid decreasing in the low strength electric field and increasing in the high strength electric field the electrorheological fluid; and a transducer acoustically coupled to the container for focusing acoustic energy into the electrorheological fluid, the focused acoustic energy being sufficient to eject a droplet of electrorheological fluid when the low strength electric field is induced in the electrorheological fluid by the electrode, and the focused acoustic energy being insufficient to eject a droplet of electrorheological fluid when the high strength electric field is induced in the electrorheological fluid by the electrode.

2. The acoustic droplet ejector according to claim 1, wherein said electrorheological fluid is an ink.

3. The acoustic droplet ejector according to claim 2, wherein said container includes an acoustic lens which focuses said acoustic energy into said focal area.

4. The acoustic droplet ejector according to claim 3, wherein said acoustic lens is cylindrical.

5. The acoustic droplet ejector according to claim 3, wherein said acoustic lens is an array of spherical lenses.

6. An acoustic droplet ejector, comprising:

a container having an opening, said container for holding an electrorheological fluid such that the electrorheological fluid has a free surface and such that droplets ejected from that free surface can pass through said opening, said container having an insulating part and a conductive part;

a conductor over said insulating part of said container;

an electrode for selectively inducing electric fields into the electrorheological fluid in response to output of a voltage source that selectively applies either a higher voltage or a lower voltage between said conductor and said electrode;

a switch for selectively applying either a higher voltage or a lower voltage between said conductor and said electrode; and a transducer for radiating bursts of acoustic energy into a focal area near the free surface of the electrorheological fluid, said radiated acoustic energy being sufficient to eject a droplet of the electrorheological fluid when said switch applies the lower voltage between said conductor and said electrode, but said radiated acoustic energy being insufficient to eject a droplet of the electrorheological fluid when the switch applies the higher voltage between said conductor and said electrode.

7. The acoustic droplet ejector according to claim 6, wherein said electrorheological fluid is an ink.

8. The acoustic droplet ejector according to claim 7, further including an acoustic lens which focuses said acoustic energy into said focal area.

9. The acoustic droplet ejector according to claim 7, further including an array of acoustic lens which focus said acoustic energy into said focal area.

10. An acoustic print head, comprising:

a container having an elongated opening defined by a first wall of an electrically conductive material and by a second wall of an electrically insulating material, said container for holding an electrorheological fluid between said first and said second walls such that the electrorheological fluid has a free surface;

a plurality of electrodes disposed adjacent said opening and said second wall, each of said electrodes for selectively inducing an electric field into said electrorheological fluid in response to the output of an associated voltage source that is capable of selectively applying either a higher voltage or a lower voltage to each electrode; and a transducer for radiating bursts of acoustic energy into a focal plane near said free surface, said radiated acoustic energy being sufficient to eject a droplet of the electrorheological fluid from a location near each of said electrodes when that electrode has the lower voltage applied thereto, but said radiated acoustic energy being insufficient to eject a droplet of the electrorheological fluid from a location near each of said electric field electrodes when that electrode has the higher voltage applied thereto.

11. The acoustic print head according to claim 10, wherein said electrorheological fluid is an ink.

12. The acoustic print head according to claim 11, further including an acoustic lens for focusing said acoustic energy into said focal area.

13. The acoustic print head according to claim 11, wherein said first wall is scalloped.

14. The acoustic print head according to claim 11, wherein said second wall is scalloped.

15. The acoustic print head according to claim 14, wherein said first wall is scalloped.

16. The acoustic print head according to claim 11, wherein said first wall has a periodicity equal to a desired droplet ejector separation.

17. The acoustic print head according to claim 11, wherein said second wall has a periodicity equal to a desired droplet ejector separation.

18. The acoustic print head according to claim 17, wherein said first wall has a periodicity equal to a desired droplet ejector separation.

19. A method of controlling droplet ejection from an electrorheological fluid comprising the steps of:

radiating acoustic energy through the electrorheological fluid such that droplets of said electrorheological fluid are ejected when a lower electric field is applied through the fluid; and selectively applying a higher electric field to the electrorheological fluid so that the viscosity of the electrorheological fluid increases sufficiently to inhibit ejection.

* * * * *